US009550187B2

(12) United States Patent
Dallimore et al.

(10) Patent No.: US 9,550,187 B2
(45) Date of Patent: Jan. 24, 2017

(54) VERTICAL SHAFT IMPACT CRUSHER FEED TUBE

(71) Applicant: SANDVIK INTELLECTUAL PROPERTY AB, Sandviken (SE)

(72) Inventors: Rowan Dallimore, Bath (GB); Andreas Forsberg, Malmo (SE); Knut Kjaerran, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 10 days.

(21) Appl. No.: 14/402,705

(22) PCT Filed: May 20, 2013

(86) PCT No.: PCT/EP2013/060335

§ 371 (c)(1),
(2) Date: Nov. 21, 2014

(87) PCT Pub. No.: WO2013/174773

PCT Pub. Date: Nov. 28, 2013

(65) Prior Publication Data

US 2015/0174582 A1 Jun. 25, 2015

(30) Foreign Application Priority Data

May 23, 2012 (EP) ..... 12169107

(51) Int. Cl.

| | |
|---|---|
| ***B02C 23/00*** | (2006.01) |
| ***B02C 13/286*** | (2006.01) |
| ***B02C 23/02*** | (2006.01) |
| ***B02C 13/18*** | (2006.01) |

(52) U.S. Cl.
CPC ..... *B02C 13/286* (2013.01); *B02C 13/18* (2013.01); *B02C 13/1807* (2013.01); *B02C 23/00* (2013.01); *B02C 23/02* (2013.01); *B02C 2013/28672* (2013.01); *Y10T 137/0318* (2015.04)

(58) Field of Classification Search
CPC ..... B02C 23/286; B02C 2013/2869; B02C 2013/28609; B02C 2013/28672
USPC ..... 241/222, 224, 186.2
See application file for complete search history.

(56) References Cited

U.S. PATENT DOCUMENTS

| | | | | |
|---|---|---|---|---|
| 321,030 | A * | 6/1885 | Hutchison | B02C 4/286 222/252 |
| 1,896,724 | A * | 2/1933 | Stein | B02C 4/286 193/2 R |
| 2,207,858 | A * | 7/1940 | Gruender | B02C 2/007 241/202 |

(Continued)

FOREIGN PATENT DOCUMENTS

| | | |
|---|---|---|
| EP | 0740961 A1 | 11/1996 |
| WO | 9632197 A1 | 10/1996 |

(Continued)

*Primary Examiner* — Faye Francis
(74) *Attorney, Agent, or Firm* — Corinne R. Gorski

(57) ABSTRACT

A vertical shaft impact crusher feed tube arranged for protecting a rotor feeding opening of a feeding funnel of a vertical shaft impact crusher. The feed tube includes a tube portion via which material may flow from the feeding funnel and vertically downwards into a rotor. The tube portion has a first width at a material inlet, and a second width at a material outlet, wherein the second width is larger than the first width.

10 Claims, 4 Drawing Sheets

(56) References Cited

U.S. PATENT DOCUMENTS 3,167,261 A * 1/1965 Wonneberger ..... A47J 42/32 241/159
3,358,939 A * 12/1967 Zoerb ..... B02C 2/007 241/202
3,785,578 A * 1/1974 Kemnitz ..... B02C 2/007 241/202
3,813,046 A * 5/1974 Kemnitz ..... B02C 2/007 241/202
3,834,631 A * 9/1974 King ..... B02C 19/0031 241/26
3,948,448 A * 4/1976 Wehren ..... B02C 23/02 241/18
3,951,348 A * 4/1976 Davis ..... B02C 2/045 241/207
3,957,213 A * 5/1976 Stockman ..... B02C 2/007 241/202
4,106,707 A * 8/1978 Kemnitz ..... B02C 2/007 241/202
4,396,158 A * 8/1983 Olsen ..... B02C 4/08 241/2
4,575,013 A * 3/1986 Bartley ..... B02C 13/1835 241/275
4,662,571 A * 5/1987 MacDonald ..... B02C 13/1835 241/275
4,738,403 A 4/1988 Sevelinge
4,754,932 A * 7/1988 Kmiotek ..... B02C 15/00 241/101.3
5,096,131 A * 3/1992 Patzelt ..... B02C 4/286 241/224
5,277,370 A * 1/1994 Schatz ..... B02C 13/1835 241/19
5,417,374 A * 5/1995 Kranz ..... B02C 4/286 241/18
7,419,110 B2 * 9/2008 Irwin ..... B02C 18/22 241/224
8,056,847 B1 * 11/2011 Sawant ..... B02C 23/02 241/275
8,074,913 B2 * 12/2011 Irwin ..... B02C 18/22 241/101.2
8,240,588 B2 * 8/2012 Muller ..... B65G 53/4633 241/224
8,757,527 B2 * 6/2014 Amano ..... A23L 1/20 241/224

FOREIGN PATENT DOCUMENTS

WO 9856508 A1 12/1998
WO 2004/020103 3/2004

* cited by examiner

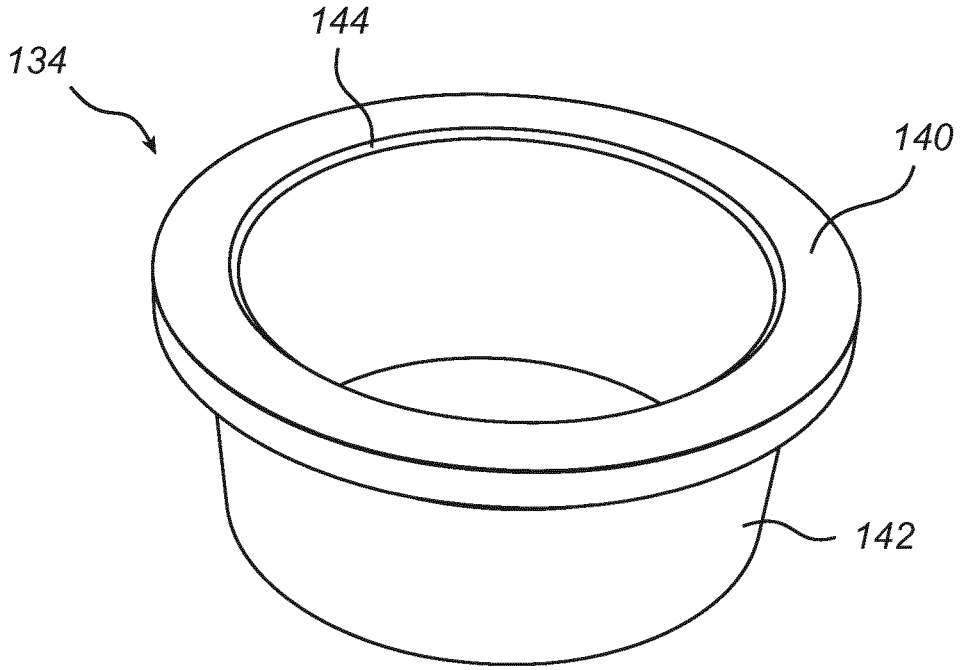
Prior art Fig. 3a
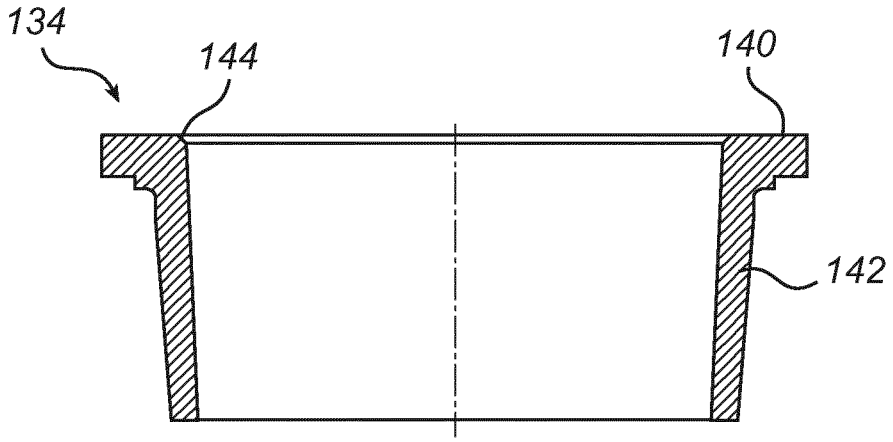
Prior art Fig. 3b

VERTICAL SHAFT IMPACT CRUSHER FEED TUBE

RELATED APPLICATION DATA

This application is a §371 National Stage Application of PCT International Application No. PCT/EP2013/060335 filed May 20, 2013 claiming priority of EP Application No. 12169107.5, filed May 23, 2012.

TECHNICAL FIELD OF THE INVENTION

The present invention relates to a vertical shaft impact crusher feed tube for protecting a rotor feeding opening of a feeding funnel arranged for feeding material to be crushed into an opening arranged in a roof of a rotor of a vertical shaft impact crusher.

The present invention further relates to a method of feeding material to a rotor of a vertical shaft impact crusher.

BACKGROUND ART

Vertical shaft impact crushers (VSI-crushers) are used in many applications for crushing hard material like rocks, ore etc. A VSI-crusher comprising a housing and a horizontal rotor located inside the housing is described in WO 2004/020103. A first flow of material to be crushed is fed to the rotor via an opening in the top thereof, is accelerated by the rotor, and is ejected towards the wall of the housing. An optional second flow of material may be fed outside of the rotor, i.e., between the rotor and the housing. This second flow of material is impacted by the first flow of material ejected by the rotor.

In some situations the operation of the crusher described in WO 2004/020103 may be disturbed by problems in the feeding of the first flow of material to the rotor, resulting in a reduced crushing efficiency of the VSI-crusher.

SUMMARY OF THE INVENTION

It is an object of the present invention to provide a device which reduces the problems of feeding material to be crushed to the rotor.

This object is achieved by a vertical shaft impact crusher feed tube for protecting a rotor feeding opening of a feeding funnel arranged for feeding material to be crushed into an opening arranged in a roof of a rotor of a vertical shaft impact crusher, the feed tube comprising a tube portion via which material may flow from the feeding funnel and vertically downwards into the rotor, wherein the tube portion has a first width at a material inlet, and a second width at a material outlet, wherein the second width is larger than the first width.

An advantage of this vertical shaft impact crusher feed tube is that it makes it possible to feed more material to the rotor of the vertical shaft impact crusher (VSI-crusher) and/or to feed larger objects to the VSI-crusher without causing problems of material getting stuck in the feeding funnel. This increases the amount of material that can be crushed in the VSI-crusher, and reduces the risk of operational disturbances. The increased amount of material fed to the rotor also has the advantage of a greater volume of material being accelerated by the rotor and towards an impact wall section of the crusher. This extra amount of accelerated material results in greater breakage ratios, i.e., a greater reduction in the size of the material fed to the VSI-crusher, in particular when a second flow of material is fed outside of the rotor and into the increased volume of the first flow of material accelerated by the rotor. Hence, not only may the first flow of material fed to the rotor be increased, but also the reduction in size may be increased, in particular when a second flow of material is fed into the first flow of material accelerated by the rotor. The result is significantly greater material tonnage throughputs of the VSI-crusher, i.e., more efficient crushing.

According to one embodiment the second width at the material outlet is a factor of 1.005 to 1.2 larger than the first width at the material inlet. If the second width is less than 1.005 times the first width there is still a risk that material to be crushed may get stuck in the tube portion, resulting in operational problems. If the second width is more than 1.2 times the first width there is a risk that the vertical flow of material into the rotor will be less well controlled, imposing a risk that pieces of rock or stone is thrown into the wrong location inside the rotor causing wear to the rotor and less efficient ejection of material from the rotor.

According to one embodiment the inside of the tube portion has the shape of a truncated cone having its base at the material outlet of the tube portion. An advantage of this embodiment is that the inside of the tube portion having the shape of a truncated cone is efficient in leading the material vertically down into the rotor, with little risk of pieces of stone or rock bouncing unintentionally in any unwanted direction.

According to one embodiment the feed tube further comprises a mounting flange adapted for mounting the feed tube to the feeding funnel, and a rock bed seat arranged for capturing a rock bed for protecting the tube portion from wear. An advantage of this embodiment is that the rock bed seat serves to protect, by means of a rock bed built up thereon, the tube portion from wear. This protection is particularly beneficial when forwarding large amounts of material through the feed tube, and/or when forwarding large objects through the feed tube, because such forwarding of large flows and/or large objects tends to cause impacting of material against the tube portion, in particular at the material inlet, and to increase the wear thereon. According to one embodiment, the rock bed seat is arranged between the mounting flange and the tube portion.

According to one embodiment the rock bed seat has a horizontal portion and a vertical portion. An advantage of this embodiment is that the rock bed seat of this type allows the rock bed to "sit" more firmly, such that the rock bed is not easily unintentionally removed by impacting rocks and/or stones comprised in the material forwarded through the feed tube on its way to the rotor.

According to one embodiment the rock bed seat has a vertical height of 10-80 mm, and a horizontal width of 30-200 mm. If the vertical height of the rock bed seat would be less than 10 mm, then the rock bed built up on the rock bed seat would be comparably thin and weak, meaning that the rock bed could be destroyed by larger impacting pieces of rock or stone, thereby leaving the feed tube unprotected. If the vertical height of the rock bed seat would be larger than 80 mm, then the height of the VSI-crusher would increase, without significantly increasing further the strength and protection conferred by the rock bed. Furthermore, if the horizontal width would be less than 30 mm, then the rock bed seat would be less efficient for capturing also larger objects, which would reduce the strength of the rock bed. If the horizontal width of the rock bed seat would be larger than 200 mm then the feed tube would become unduly heavy and costly, without further significantly increasing the strength of the rock bed captured on the rock bed seat.

According to one embodiment the tube portion has a total height, as seen from the material inlet to the material outlet, which is 40% or less of the first width. An advantage of this embodiment is that the risk that material and/or large objects may get stuck in the tube portion is reduced when the tube portion has a rather short length in relation to its first width.

According to one embodiment the tube portion has a total height, as seen from the material inlet to the material outlet, which is at least 15% of the first width. An advantage of this embodiment is that a height of the tube portion which is at least 15% of the first width is beneficial for providing the material with a suitable downward direction into the rotor. This reduces the risk that material to be crushed ends up in the wrong part of the rotor, and/or even ends up on the roof of the rotor, rather than inside the rotor.

A further object of the present invention is to provide a method of feeding material to a rotor of a VSI-crusher, such method being more efficient than the methods of the prior art.

This object is achieved by a method of feeding material to a rotor of a vertical shaft impact crusher, the method comprising:

feeding material to be crushed from a feeding funnel and into an opening arranged in a roof of the rotor of the vertical shaft impact crusher, protecting a rotor feeding opening of the feeding funnel by a vertical shaft impact crusher feed tube, and allowing the material to flow through a tube portion of the feed tube, wherein the material to be crushed is exposed to a cross-section of the tube portion that widens from a first width to a second width, which is larger than the first width, as the material flows vertically downwards through the tube portion towards the rotor.

An advantage of this method is that large objects and/or large flows of material to be crushed can be supplied to the rotor with little or no risk of such material getting stuck before entering the rotor.

According to one embodiment the method comprises allowing the material to flow through the tube portion having the shape of a truncated cone having its base at a material outlet of the tube portion. An advantage of this embodiment is that a controlled, and yet unimpeded, flow of material is forwarded from the feeding funnel and into the rotor via the feed tube.

According to one embodiment the method comprises collecting material at a rock bed seat of the feed tube to form a rock bed protecting the tube portion. An advantage of this embodiment is that the life of the feed tube is increased.

According to one embodiment the method comprises forwarding the material vertically downwards through the tube portion a vertical distance which is 15 to 40% of the first width. An advantage of this distance is that it allows good control of the direction of the material to be crushed, without increasing the risk of the material getting stuck at the inside of the tube portion.

Further objects and features of the present invention will be apparent from the description and the claims.

BRIEF DESCRIPTION OF THE DRAWINGS

The invention will hereafter be described in more detail and with reference to the appended drawings.

FIG. 3*a* is a three-dimensional view, and illustrates a vertical shaft impact crusher feed tube according to prior art.

FIG. 3*b* is a cross-section of the prior art feed tube of FIG. 3*a*.

DETAILED DESCRIPTION OF PREFERRED EMBODIMENTS OF THE INVENTION

Figure 1:
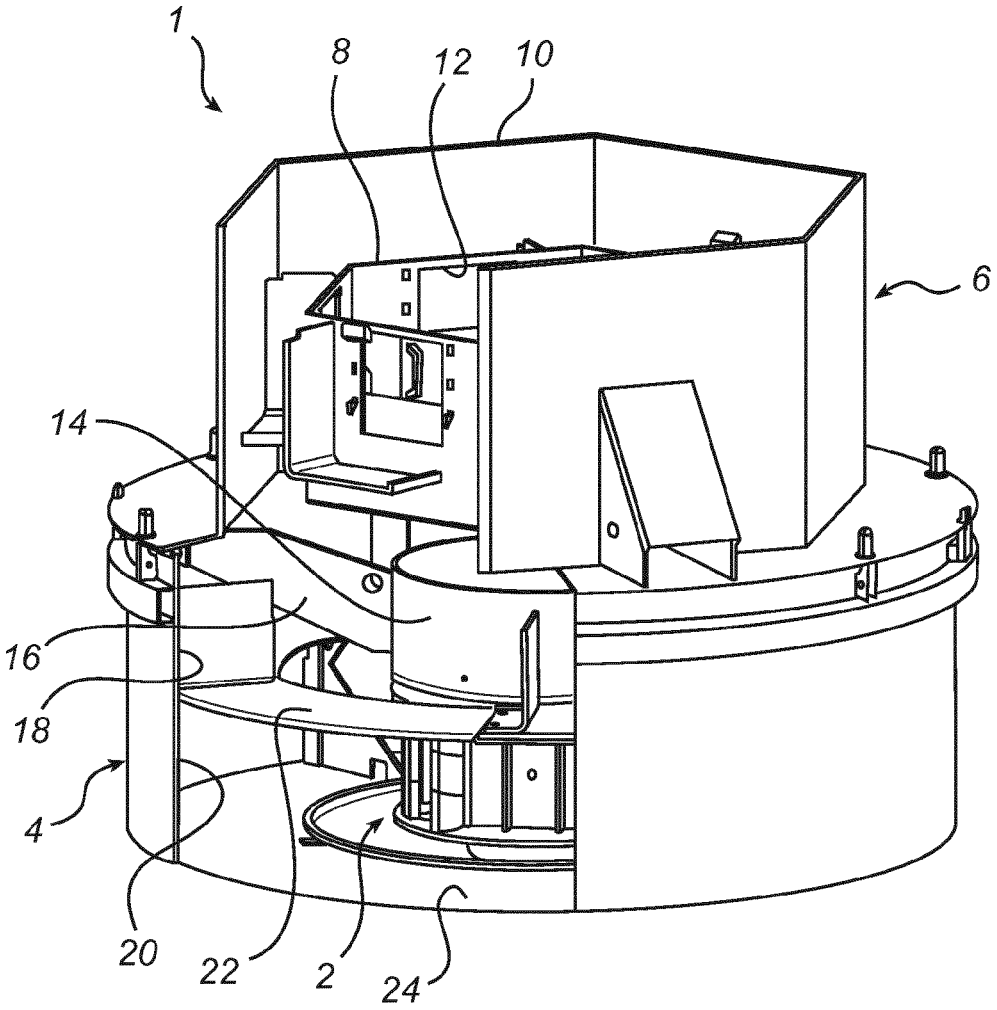
FIG. 1 is a three-dimensional view, partly in section, and illustrates a vertical shaft impact crusher.

FIG. 1 illustrates, partly in cross-section, a vertical shaft impact (VSI) crusher 1. A rotor 2 is located inside a housing 4 of the crusher 1. The rotor 2 may, for example, be of a per se known type, for example of the type disclosed in WO 2004/020103. At the top of the crusher 1 a feed hopper means 6 is located. The feed hopper means 6 has an inner hopper 8, and an outer hopper 10 surrounding the inner hopper 8.

Outlets 12 are arranged in the inner hopper 8. Below the inner hopper 8 a central feeding funnel 14 is placed. The central feeding funnel, which in this embodiment has the shape of a central feeding cylinder 14, is fixed to the inside of the housing 4 with the aid of three beams, of which only the beam 16 is shown in FIG. 1.

A circumferential distributing wall section 18 is located at the same level as the feeding cylinder 14. Below the distributing wall section 18 and on the same level as the rotor 2 a circumferential impact wall section 20 is located. A cavity ring 22 separates the distributing wall section 18 from the impact wall section 20. A bed retention ring 24 is located at the bottom of the crusher 1.

Figure 2:
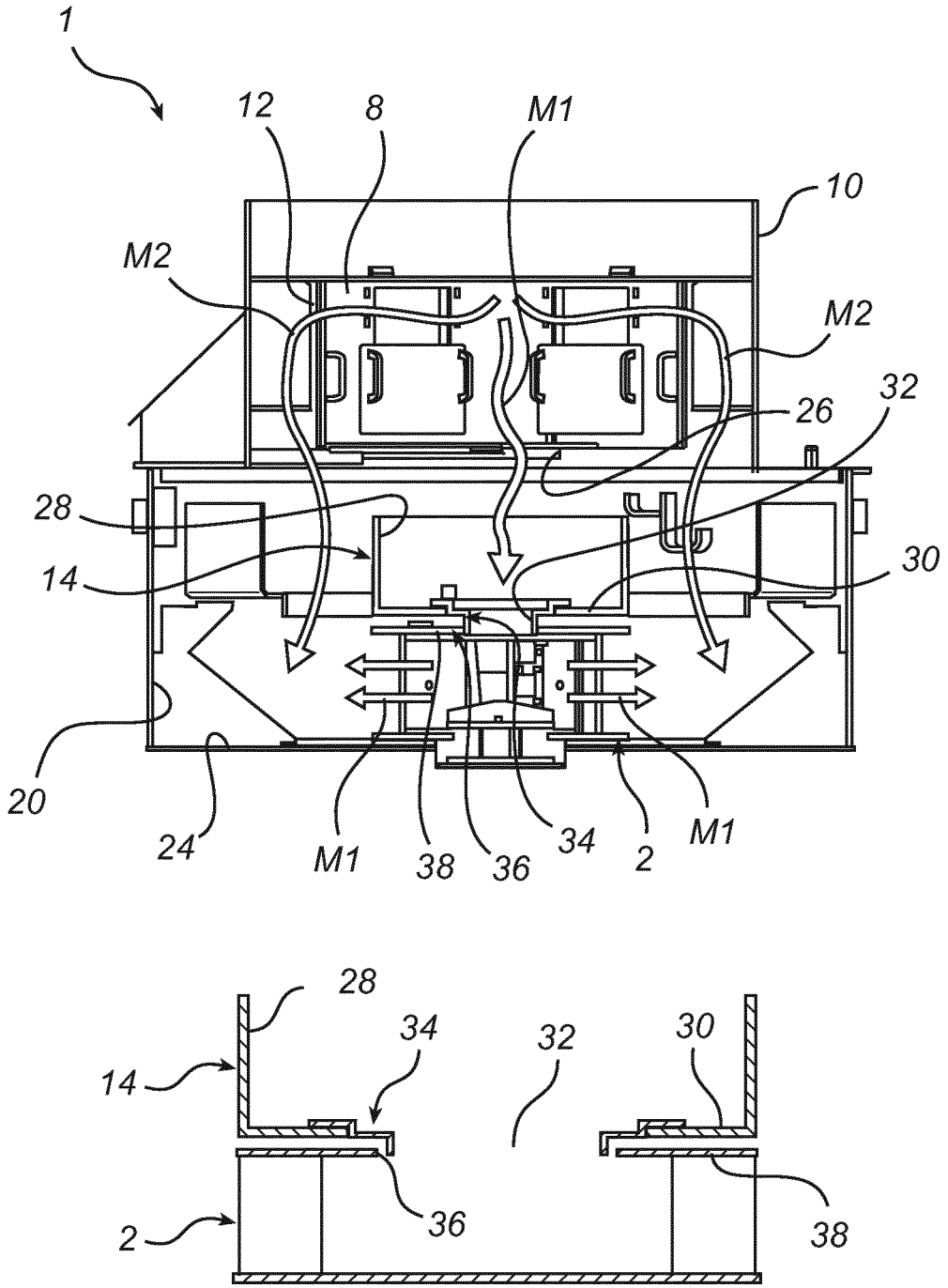
FIG. 2 is a cross-section, and illustrates internal parts of the vertical shaft impact crusher, including an enlarged view of a rotor and feeding cylinder thereof.

FIG. 2 is cross-section of the VSI-crusher 1. Below the main cross-section of FIG. 2 an enlarged view of the feeding cylinder 14 and the rotor 2 has been included. During operation of the VSI-crusher 1 material to be crushed is fed to the inner hopper 8. A first flow of material M1 will reach the rotor 2 via a hopper opening 26, which is located at the bottom of the inner hopper 8, and the feeding cylinder 14, and a second flow of material M2 will be forwarded outside of the rotor 2 via the outlets 12. The second flow of material M2 leaving the outlets 12 will pass, outside of the rotor 2, down into a position adjacent to the impact wall section 20. Adjacent to the impact wall section 20 the second flow of material M2 will be hit by the first flow of material M1 ejected by the rotor 2, which will result in crushing of both material flows M1 and M2. A bed of retained material (not shown), against which the two flows of material M1 and M2 may impact, is built up on the bed retention ring 24 during operation of the crusher 1, and protects the impact wall section 20 from wear.

The central feeding cylinder 14 comprises a side wall 28, which may, for example, be circular, and a bottom 30. The bottom 30 of the feeding cylinder 14 is provided with a centrally arranged rotor feeding opening 32 through which the first material flow M1 may pass from the central feeding cylinder 14 and into the rotor 2.

To protect the internal edges of the rotor feeding opening 32 a vertical shaft impact crusher feed tube 34 is mounted to the bottom 30, extends through the rotor feeding opening 32, and opens into an opening 36 arranged in a roof 38 of the rotor 2.

FIGS. 3*a* and 3*b* illustrate a vertical shaft impact crusher feed tube 134 according to prior art. The prior art feed tube 134 comprises a mounting flange 140 and a tube portion 142 via which material to be crushed is to pass into a rotor. At its inner upper side the tube portion 142 is provided with a beveling 144 having an angle of about 45° to the horizontal plane. The interior of the tube portion 142 tapers slightly in the downward direction.

Figure 4A:
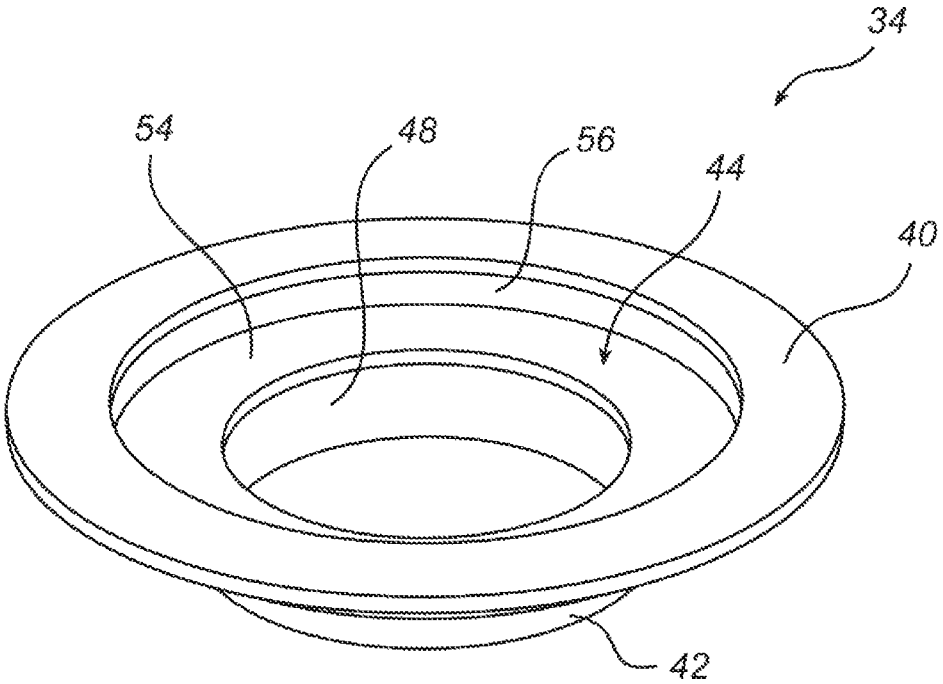
FIG. 4*a* is a three-dimensional view, and illustrates a vertical shaft impact crusher feed tube according to one embodiment of the present invention.
Figure 4B:
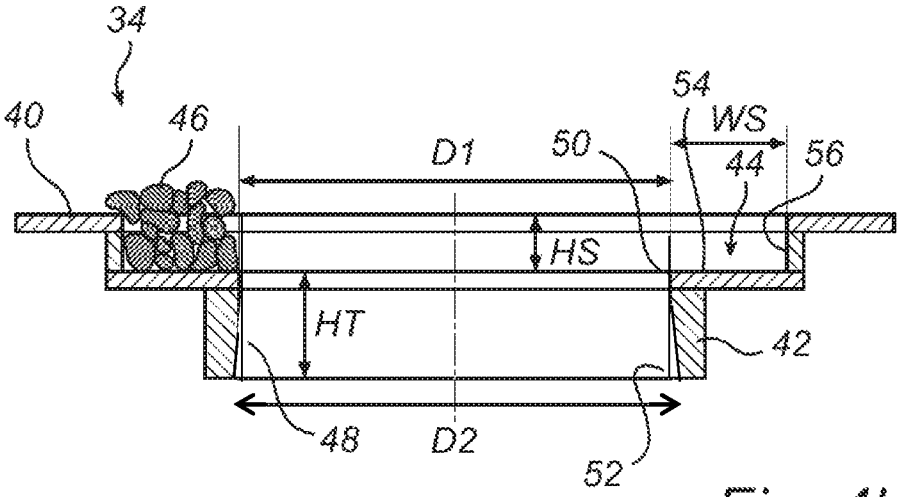
FIG. 4*b* is a cross-section of the feed tube of FIG. 4*a*.

FIG. 4*a* is a three-dimensional view, and illustrates the vertical shaft impact crusher feed tube 34 according to one embodiment of the present invention. FIG. 4*b* is a cross-section of the feed tube 34 of FIG. 4*a*. The feed tube 34 illustrated in FIGS. 4*a* and 4*b* comprises a mounting flange 40 and a tube portion 42 through which material to be crushed is to pass into a rotor. The mounting flange 40 is arranged for being mounted to the bottom 30 of the feeding cylinder 14 illustrated in FIG. 2. Returning to FIGS. 4*a* and 4*b*, a rock bed seat 44 is arranged between the mounting flange 40 and the tube portion 42. During operation of the VSI-crusher a rock bed 46, only shown in part in FIG. 4*b*, builds up on the rock bed seat 44 and protects the rock bed seat 44 itself and also the tube portion 42 from wear.

The tube portion 42 has an inside 48 which tapers when viewed in an upward direction. At a material inlet 50 of the tube portion 42, the material inlet 50 being located in an upper end of the tube portion 42, the tube portion 42 has a first width, which is a diameter D1 in the circular tube portion 42 of the embodiment of FIGS. 4*a* and 4*b*. At a material outlet 52, the material outlet 52 being located in a lower end of the tube portion 42, the tube portion 42 has a second width, which is a diameter D2 in the circular tube portion 42. The second width, i.e. D2, is larger than the first width, i.e. D1. According to a preferred embodiment, the second width D2 would be a factor of 1.005 to 1.2, more preferably a factor of 1.01 to 1.07, larger than the first width D1. For example, if the first width D1 is 400 mm, then the second width D2 could be, for example 400×1.05=420 mm.

According to one embodiment, illustrated in FIGS. 4*a*-4*b*, the inside 48 of the tube portion 42 has the shape of a truncated cone having its base at the lower end, i.e., at the material outlet 52, of the tube portion 42. Preferably, the inside 48 has a smooth surface.

The tube portion 42 preferably has a total height HT, as seen from the material inlet 50 to the material outlet 52, which is 40% or less, more preferably less than 30%, of the first width D1. Preferably the total height HT of the tube portion 42 is within the range 15-40%, more preferably within the range 20-30%, of the first width D1. For example, if the first width D1 is 400 mm, then the total height HT of the tube portion 42 could be, for example, 400×0.25=100 mm.

The seat 44 has a horizontal portion 54 and a vertical portion 56. The upper surface of the horizontal portion 54 is essentially flush with the material inlet 50. The seat 44 has a vertical height HS, which is preferably 10-80 mm, and a horizontal width WS, which is preferably 30-200 mm, to effectively retain the rock bed 46 for protection of the seat 44 itself and the tube portion 42.

The feed tube 34 could be manufactured from, for example, manganese steel, other hard steel materials, ceramic materials, etc. The feed tube 34 could be manufactured from combinations of several materials. For example, the tube portion 42 could be manufactured from a highly wear resistant material, such as a ceramic, while the seat 44, which is covered by the rock bed 46, could be manufactured from a less wear resistant material.

It will be appreciated that numerous modifications of the embodiments described above are possible within the scope of the appended claims.

Hereinbefore it has been described that the tube portion 42 has a circular cross-section, as best shown in FIG. 4*a*. It will be appreciated that the tube portion 42 may, in alternative embodiments, have another cross-section. Examples of such other cross-sections of the tube portion 42 includes, but is not limited to, oval, square, pentagonal, hexagonal, heptagonal, and octagonal cross-sections. In case the tube portion has, for example, a square cross-section the first and second widths would be the first and second diagonals of the respective square, rather than the first and second diameters, as is the case with a circular cross-section. In case the tube portion has another cross-section, such as oval or hexagonal cross-section, the first and second widths would be the widest width/diagonal of such cross-section, and taken at the same position at both the material inlet and at the material outlet.

Hereinbefore it has been described, with reference to FIGS. 1 and 2, that the VSI-crusher 1 is designed for a first material flow M1 flowing through the rotor 2, and a second material flow M2 passing outside of the rotor 2 and being hit by the first material flow M1 ejected by the rotor 2. It will be appreciated that the VSI-crusher feed tube 34 described with reference to FIGS. 4*a*-4*b* may also be utilized for VSI-crushers in which the entire flow of material to be crushed is fed to the rotor 2.

To summarize, a vertical shaft impact crusher feed tube 34 is adapted for protecting a rotor feeding opening 32 of a feeding funnel 14 of a vertical shaft impact crusher 1. The feed tube 34 comprises a tube portion 42 via which material may flow from the feeding funnel 14 and vertically downwards into the rotor 2. The tube portion 42 has a first width D1 at a material inlet 50, and a second width D2 at a material outlet 52, wherein the second width D2 is larger than the first width D1.

The invention claimed is:

1. A vertical shaft impact crusher comprising:

a feeding funnel arranged for feeding material to be crushed into an opening of a rotor of the vertical shaft impact crusher, the feeding funnel having a rotor feeding opening; and a feed tube for protecting the rotor feeding opening, the feed tube including a tube portion associated with the rotor feeding opening of the feeding funnel via which material may flow from the feeding funnel and vertically downwards into the rotor, a mounting flange arranged for mounting the feed tube to the feeding funnel, and a bed seat arranged between the mounting flange and the tube portion arranged to capture a bed of the material for protecting the tube portion from wear, the bed seat having a horizontal portion and a vertical portion, wherein the tube portion has a first width at a material inlet, and a second width at a material outlet, wherein the second width is larger than the first width.

2. The crusher according to claim 1, wherein the second width at the material outlet is a factor of 1.005 to 1.2 larger than the first width at the material inlet.

3. The crusher according to claim 1, wherein an inside surface of the tube portion slopes outwardly from the material inlet to the material outlet, such that its base is at the material outlet of the tube portion.

4. The crusher according to claim 1, wherein the bed seat has a vertical height of 10-80 mm, and a horizontal width of 30-200 mm.

5. The crusher according to claim 1, wherein the tube portion has a total height, from the material inlet to the material outlet, which is 40% or less of the first width.

6. The crusher according to claim 1, wherein the tube portion has a total height, from the material inlet to the material outlet, which is at least 15% of the first width.

7. A method of feeding material to a rotor of a vertical shaft impact crusher, the method comprising:

feeding material to be crushed from a feeding funnel, the feeding funnel being arranged to feed material to be crushed into an opening arranged in a roof of the rotor of the vertical shaft impact crusher, the feeding funnel having a rotor feeding opening;

providing a vertical shaft impact crusher tube, the feed tube including a tube portion associated with the rotor feeding opening of the feeding funnel, a mounting flange arranged for mounting the feed tube to the feeding funnel, and a bed seat arranged between the mounting flange and the tube portion, the bed seat having a horizontal portion and a vertical portion;

protecting the rotor feeding opening of the feeding funnel by the vertical shaft impact crusher feed tube; and allowing the material to flow through a tube portion of the feed tube, wherein the material to be crushed is exposed to a cross-section of the tube portion that widens from a first width to a second width, which is larger than the first width, as the material flows vertically downwards through the tube portion towards the rotor.

8. A method according to claim 7, further comprising allowing the material to flow through the tube portion having the shape of a truncated cone having its base at a material outlet of the tube portion.

9. A method according to claim 7, further comprising collecting material at the bed seat of the feed tube to form a bed of material for protecting the tube portion.

10. A method according to claim 7, further comprising forwarding the material vertically downwards through the tube portion by a vertical distance which is 15 to 40% of the first width.

* * * * *